US006097828A

United States Patent [19]

Suzuki et al.

[11] Patent Number: 6,097,828

[45] Date of Patent: Aug. 1, 2000

[54] ELECTROACOUSTIC TRANSDUCER

[75] Inventors: Kazushi Suzuki; Yoshio Imahori; Kazushige Tajima, all of Shizuoka, Japan

[73] Assignee: Star Micronics Co., Ltd., Shizuoka, Japan

[21] Appl. No.: 08/783,707

[22] Filed: Jan. 15, 1997

[30] Foreign Application Priority Data

Jan. 16, 1996 [JP] Japan ..... 8-023082

[51] Int. Cl.[7] ..... H04R 25/00

[52] U.S. Cl. ..... 381/409; 381/417; 381/396

[58] Field of Search ..... 381/396, 398, 381/423, 89, FOR 152, FOR 165, 417, 409, 410; 29/594; 367/172, 173, 175

[56] References Cited

U.S. PATENT DOCUMENTS 5,394,479 2/1995 Ishigaya et al. ..... 381/396
5,432,758 7/1995 Sone ..... 381/398

FOREIGN PATENT DOCUMENTS 5-80774 4/1993 Japan ..... G10K 9/18

*Primary Examiner*—Huyen Le
*Attorney, Agent, or Firm*—Sughrue, Mion, Zinn, Macpeak & Seas, PLLC

[57] ABSTRACT

In an electroacoustic transducer having an outer case integral with lead terminals and a drive section including a coil disposed in the outer case with both coil terminals of the coil being led out on and connected to lands of the lead terminals, the lands are formed in approximately circular shapes.

5 Claims, 16 Drawing Sheets

FIG.12

| | LAND SHAPE | LAND AREA | AMOUNT OF SOLDER | HEATING TIME | HEIGHT OF FINISHED SOLDER |
|---|---|---|---|---|---|
| PRIOR ART | 2 x 2.7 | 5.4 mm² | 0.24 g | 100 msec | $\bar{x}$ = 0.47 mm |
| EMBODIMENT | Φ 2.8 | 6.2 mm² | 0.24 g | 70 msec | $\bar{x}$ = 0.29 mm |

ELECTROACOUSTIC TRANSDUCER

BACKGROUND OF THE INVENTION

1. Field of the Invention

The present invention relates to an electroacoustic transducer, and, more particularly, to an electroacoustic transducer, which has an outer case formed integral with lead terminals and a coil having both coil terminals connected to lands of the lead terminals wherein the shapes of the lands of the lead terminals are specifically designed to improve the quality of the connecting portions.

2. Description of the Related Art

An electroacoustic transducer, such as an electromagnetic type electroacoustic transducer, has a structure as shown in FIGS. 19 through 23. As shown in FIGS. 20 and 21, a case 201 has a base member 203 attached to its bottom. A base 205 and a core 207 are integrally secured on the base member 203 and inside the case 201. The integration of the base 205 and the core 207 is called "pole piece." A coil 209 is wound around the core 207. A support ring 211 is disposed around the coil 209, and a magnet 213 is provided on the inner wall of the support ring 211. A ring-like clearance is formed between the magnet 213 and the coil 209. Formed at the left-hand end portion of the support ring 211 in FIG. 21 is a step portion 215 at which a diaphragm 216 is provided. This diaphragm 216 comprises an elastic plate (also called a resonance plate) 217 and a magnetic piece 219 attached as an added mass to the center portion of this elastic plate 217.

In the thus constituted electromagnetic type electroacoustic transducer, as shown in FIG. 20, lead terminals 221 and 223 have previously been attached in an integral manner to the base member 203 by inserting. In this case, as shown in FIG. 20, both coil terminals 209*a* and 209*b* of the coil 209 are led out on lands 221*a* and 223*a* of the lead terminals 221 and 223 and are securely soldered to those lands.

The aforementioned inserting method will now be discussed specifically. As shown in FIG. 19, a lead frame 225 previously patterned in a predetermined shape is prepared. The lead frame 225 has a plurality of lead frame elements 227 (surrounded by an alternate one long and two short dashes line in FIG. 19) coupled side by side, so that a plurality of electromagnetic type electroacoustic transducers (four electroacoustic transducers in this case) are manufactured at the same time. FIGS. 22 and 23 show the details of the lead frame elements 227. The lead frame element 227 has a pair of wide portions 227*a* and 227*b*, extending horizontally in FIG. 22, and protruding pieces 227*c*, 227*d*, 227*e* and 227*f* are provided between the pair of wide portions 227*a* and 227*b*. The distal end portions of the protruding pieces 227*c* and 227*d* become the aforementioned lead terminals 221 and 223.

As shown in FIG. 19, the constituting elements of each electromagnetic type electroacoustic transducer are placed at the proper positions of the lead frame elements 227 of the lead frame 225 in a mold (not shown). Then, a resin is filled in the mold to form the aforementioned base member 203, at which time the lead frame elements 227 partially become integrated with the interior of the base member 203. Thereafter, the lead frame elements 227 are cut along a cut line A shown in FIG. 19 and the exposed portions are bent, providing the state shown in FIG. 20.

Besides the lead terminals 221 and 223, terminal members 229 and 231 which do not perform electric functions are likewise integrated with the base member 203. That is, the distal end portions of the protruding pieces 227*e* and 227*f* shown in FIG. 22 become the terminal members 229 and 231.

In the thus constituted electromagnetic type electroacoustic transducer, the elastic plate 217 integrally provided with the magnetic piece 219 is set to have a given polarity by the magnet 213. When a current flows across the coil 209 via the lead terminals 221 and 223 under this situation, the core 207 is magnetized, generating a magnetic field at the distal end. When the magnetic pole of the core 207 induced by the coil 209 is different from the magnetic pole induced by the magnet 213 attached to the elastic plate 217, the elastic plate 217 is attracted to the core 207. When the former magnetic pole of the core 207 is the same as the latter magnetic pole induced by the magnet 213, the elastic plate 217 is repelled against the core 207. By allowing the current to intermittently flow in either direction, therefore, the elastic plate 217 repeats the above-described operation. In other words, the elastic plate 217 vibrates at a given frequency, thus generating a sound.

This electromagnetic type electroacoustic transducer is then to be incorporated into any desired device, such as a portable telephone or a pager. To accomplish this, as shown in FIG. 21, this electroacoustic transducer is attached to a mounting board 237 (indicated by an alternate one long and two short dashes line in FIG. 21) of the device in the illustrated manner, and is soldered thereto via the lead terminals 221 and 223 and the lead terminals 229 and 231 which do not perform electric functions.

This kind of electromagnetic type electroacoustic transducer is disclosed in, for example, Unexamined Japanese Patent Publication No. Hei 5-80774.

The above-described prior art structure has the following shortcoming. As has already been described, both coil terminals 209*a* and 209*b* of the coil 209 are led out on the lands 221*a* and 223*a* of the lead terminals 221 and 223 and securely soldered there. The coil 209 has an insulator coat of polyurethane, polyester or the like applied on the outer surface of a copper wire with an outside diameter of 0.05 to 0.06 mm, and further has a deposited coat of modified nylon or the like applied on the insulator coat. The peripheral portions of the lead terminals 221 and 223 are made of a material susceptible to heat, such as thermoplastic resin. In respectively soldering the coil terminals 209*a* and 209*b* to the lands 221*a* and 223*a*, first, the insulator coats and deposited coats of the coil terminals 209*a* and 209*b* are melted away, thus exposing the copper wires. Under this condition, the coil terminals 209*a* and 209*b* are soldered to the respective lands 221*a* and 223*a*. This soldering should be performed quickly because the peripheral portions of the lands 221*a* and 223*a* are made of thermoplastic resin which is susceptible to heat.

In the case where soldering is carried out on the lands 221*a* and 223*a*, a solder paste when dropped on the lands 221*a* and 223*a* becomes as illustrated in FIG. 24. Solder naturally spreads in a circular shape or a dome shape. As the conventional lands 221*a* and 223*a* have approximately rectangular shapes, the surface tension strongly acts in the lengthwise direction of the lands 221*a* and 223*a* so that the solder spreads in this direction, as shown in FIGS. 24 and 25. The insulator coat and deposited coat portions of the coil terminals 209*a* and 209*b* are not yet melted away in the initial stage of soldering, and the solder is not yet wetted at those insulator coat and deposited coat portions (the solder is not yet well applied). As a result, "solder splitting" (which causes solder to be split into two in the lengthwise direction with the insulator coat and deposited coat portions as the boundary) as shown in FIGS. 25 and 26. When such solder splitting occurs, the coil terminals 209*a* and 209*b* are not properly soldered to the respective lands 221*a* and 223*a*. This improper connection leads to a loss of the electric function.

One reason why the lands 221*a* and 223*a* are designed to be approximately rectangular is its easier positioning of the coil terminals 209*a* and 209*b* on the respective lands 221*a* and 223*a*. In other words, even when the positions of the coil terminals 209*a* and 209*b* led on the respective lands 221*a* and 223*a* are slightly deviated from the center positions, the effective soldering area of each land does not vary so much.

To suppress the occurrence of the aforementioned solder splitting, the insulator coat and deposited coat portions of the coil terminals 209*a* and 209*b* should surely be melted away, which requires a longer heating time in the soldering job. The increased heating time may thermally damage the peripheral portions of the lands 221*a* and 223*a* made of thermoplastic resin. In this respect, the heating time cannot be made longer after all.

Alternatively, the amount of solder used may be increased in which case the solder height at the soldered portion becomes higher, reducing the volume of the resonance space in the case 201. This results in an insufficient resonance effect. Further, the increased solder height at the soldered portion stands in the way of making an electromagnetic type electroacoustic transducer thinner and more compact.

The occurrence of solder splitting may be prevented by repeating quick heating at the soldering time. In this case, the soldering work becomes troublesome and takes time.

As apparent from the above, it is significantly difficult to suppress the occurrence of solder splitting while maintaining the properness of the peripheral portions of the lands 221*a* and 223*a*, which are susceptible to heat, ensuring a thinner and more compact electromagnetic type electroacoustic transducer without degrading its performance, and avoiding making the soldering work troublesome.

SUMMARY OF THE INVENTION

Accordingly, it is an object of the present invention to provide an electroacoustic transducer which can suppress the occurrence of solder splitting while maintaining the properness of the peripheral portions of the lands, which are susceptible to heat, ensuring a thinner and more compact electromagnetic type electroacoustic transducer without degrading its performance, and avoiding making the soldering work troublesome.

To achieve the above object, according to this invention, in an electroacoustic transducer having an outer case formed integral with lead terminals and a drive section including a coil disposed in the outer case with both coil terminals of the coil being led out on and connected to lands of the lead terminals, the lands are formed in approximately circular shapes.

As the lands of the lead terminals have approximately circular shapes, at the time of connecting the coil terminals to the lands by solder, for example, the spreading shape of a solder paste when dropped can match with the shape of the lands. This prevents the dropped solder paste from being drawn and spread in one direction, thus suppressing the occurrence of solder splitting. It is therefore possible to eliminate improper connection, thus improving the reliability of the electroacoustic transducer.

In this electroacoustic transducer, members made of a material susceptible to heat may be arranged at peripheral portions of the lands.

Further, the outer case may be formed integral with a lead frame previously formed into a predetermined shape, and parts of the lead frame may serve as the lead terminals.

In this modification, members made of a material susceptible to heat may be arranged at peripheral portions of the lands, too.

Both coil terminals may be connected to the lands of the lead terminals by solder or an adhesive.

The lead terminals may be located inside or outside the outer case.

Furthermore, the electroacoustic transducer may be an electromagnetic type.

When the lead terminals are placed inside the outer case, the solder height at the soldered portion become lower. This can contribute to designing the electroacoustic transducer compact (thinner) and increasing the volume of the internal resonance space, thus improving the acoustic performance.

When the lead terminals are placed outside the outer case, the solder height at the soldered portion become lower. Accordingly, the outside dimension of the electroacoustic transducer can be made smaller.

When members made of a material susceptible to heat are located at peripheral portions of the lands, the thermal influence on the lands' peripheral portions can be reduced, thus allowing the properness of those peripheral portions to be maintained.

BRIEF DESCRIPTION OF THE DRAWINGS

FIG. 12 is a diagram showing one example of the first embodiment in comparison with prior art;

DETAILED DESCRIPTION OF THE PREFERRED EMBODIMENTS

First Embodiment

Figure 1:
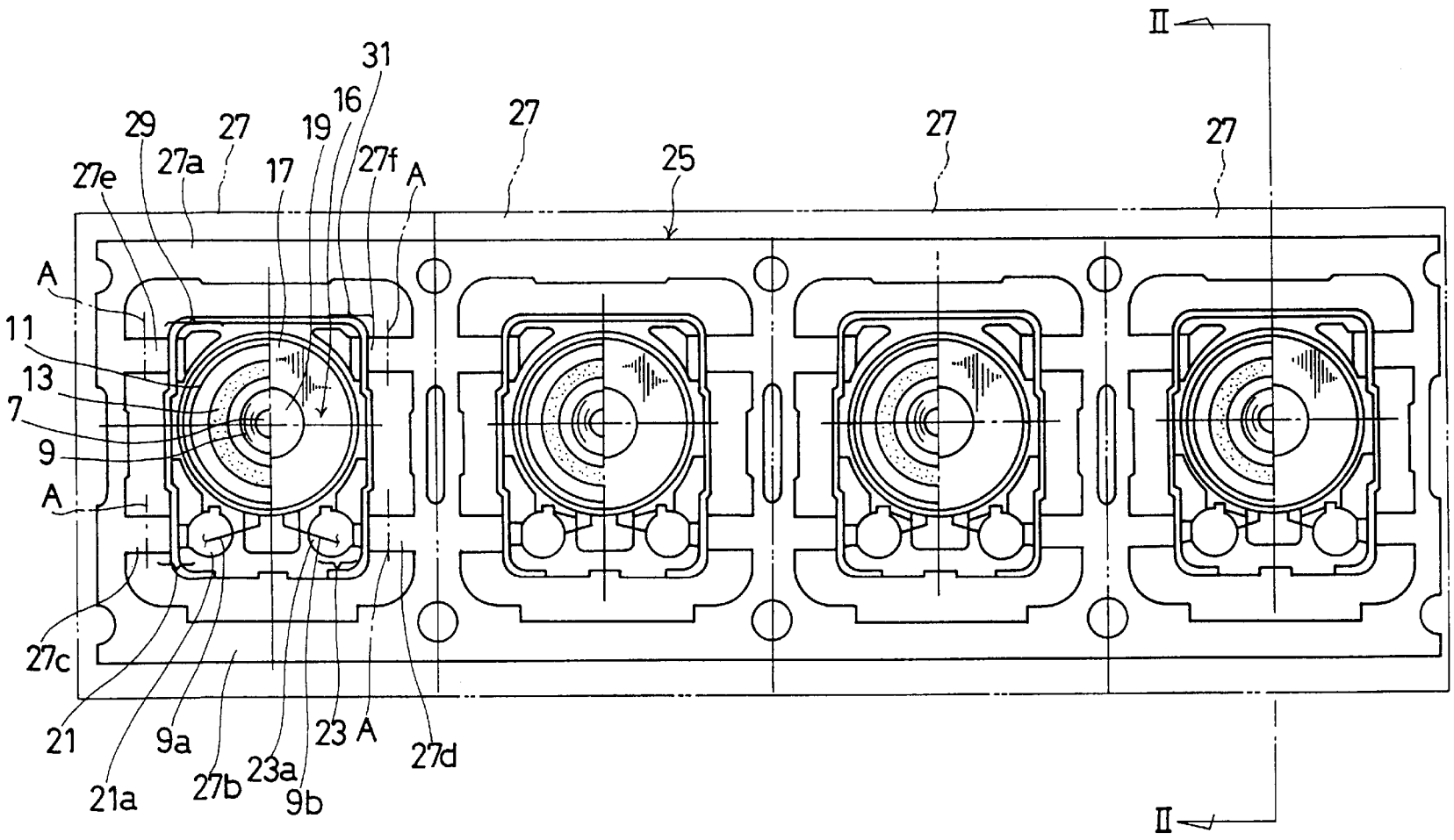
FIG. 1 is a plan view of an electroacoustic transducer according to the first embodiment of this invention, illustrating how a base member is formed integral, by inserting, with a lead frame on which the components of the electroacoustic transducer are arranged.
Figure 2:
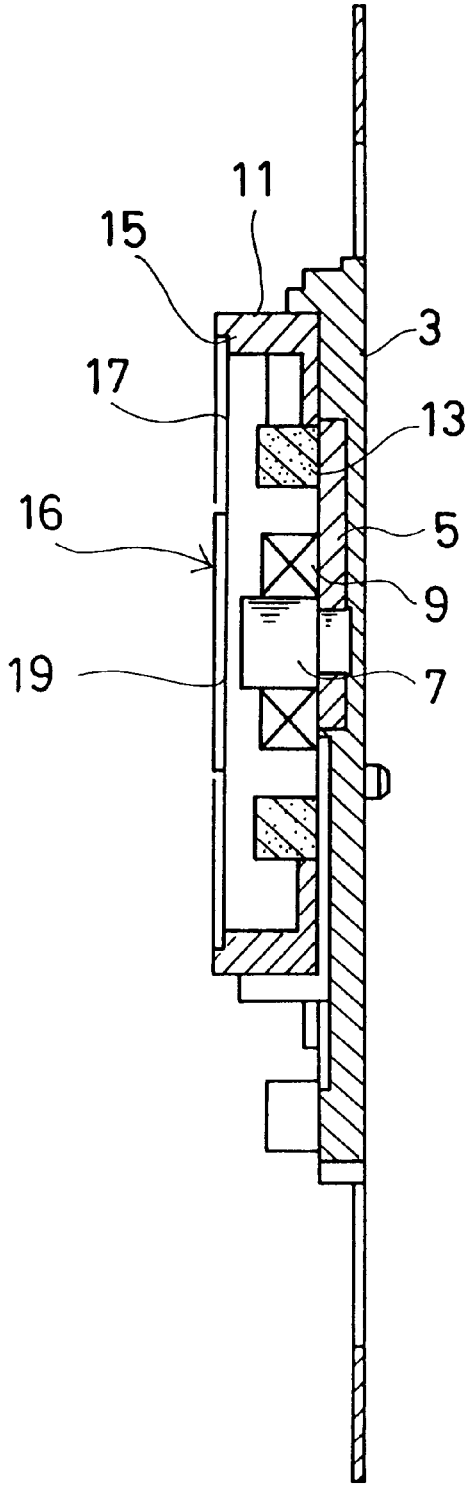
FIG. 2 is a cross-sectional view of the first embodiment taken along the line II—II in FIG. 1.

The first embodiment of the present invention will now be described with reference to FIGS. 1 through 11. To begin with, the structure of an electromagnetic type electroacoustic transducer according to this embodiment will be discussed referring to FIGS. 3 and 4. A case 1 has a base member 3 attached to its bottom. A base 5 and a core 7 are integrally secured on the base member 3 and inside the case 1. The integration of the base 5 and the core 7 is called "pole piece." A coil 9 is wound around the core 7. A support ring 11 is disposed around the coil 9, and a magnet 13 is provided on the inner wall of the support ring 11. A ring-like clearance is formed between the magnet 13 and the coil 9. Formed at the left-hand end portion of the support ring 11 in FIG. 4 is a step portion 15 at which a diaphragm 16 is provided. This diaphragm 16 comprises an elastic plate (also called a resonance plate) 17 and a magnetic piece 19 attached as an added mass to the center portion of this elastic plate 17.

Figure 3:
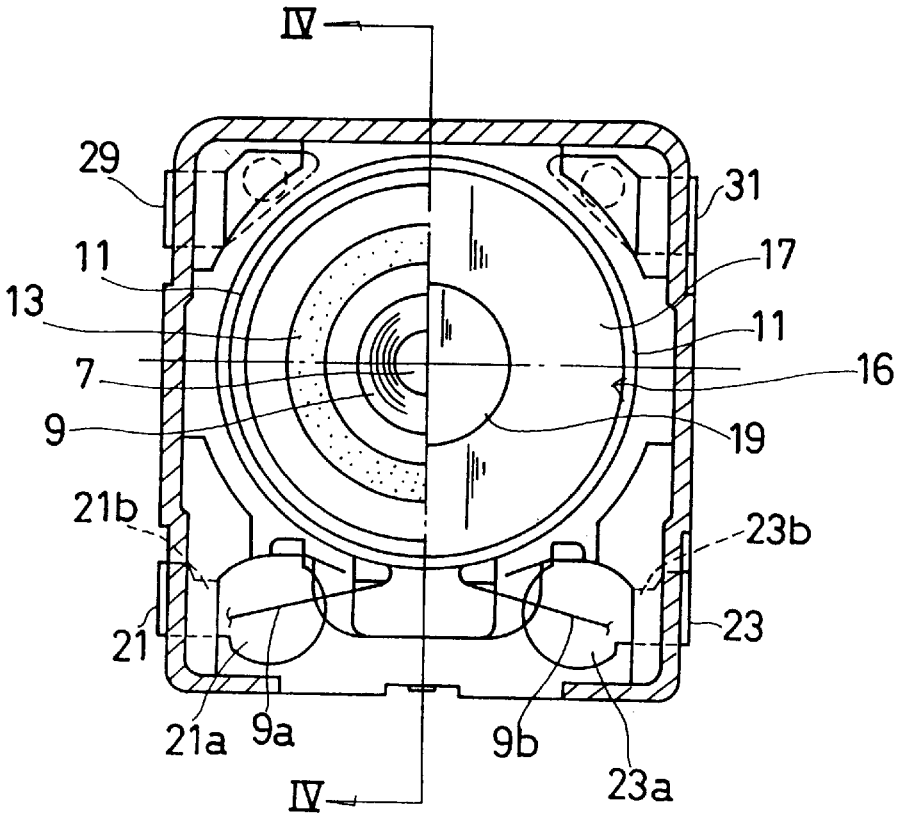
FIG. 3 is a plan view of the first embodiment, showing an elastic plate and a magnetic piece with a part of an upper case cut away, and showing a pole piece, a coil, a magnet and the like with parts of the elastic plate and magnetic piece cut away.
Figure 4:
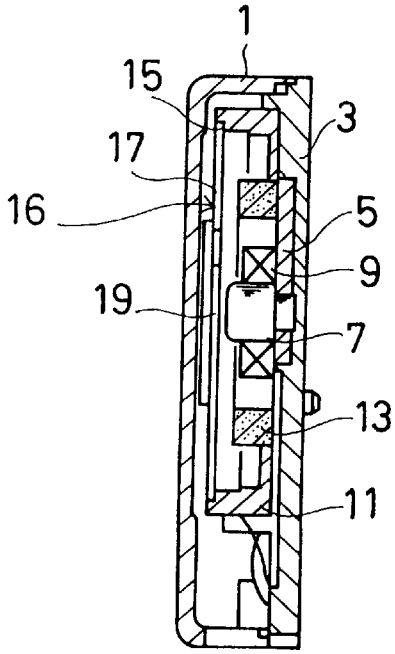
FIG. 4 is a cross-sectional view of the first embodiment taken along the line IV—IV in FIG. 3.

In the thus constituted electromagnetic type electroacoustic transducer, as shown in FIG. 3, lead terminals 21 and 23 have previously been attached in an integral manner to the base member 3 by inserting. In this case, as shown in FIG. 3, both coil terminals 9*a* and 9*b* of the coil 9 are led out on lands 21*a* and 23*a* of the lead terminals 21 and 23 and are securely soldered to those lands.

Figure 5:
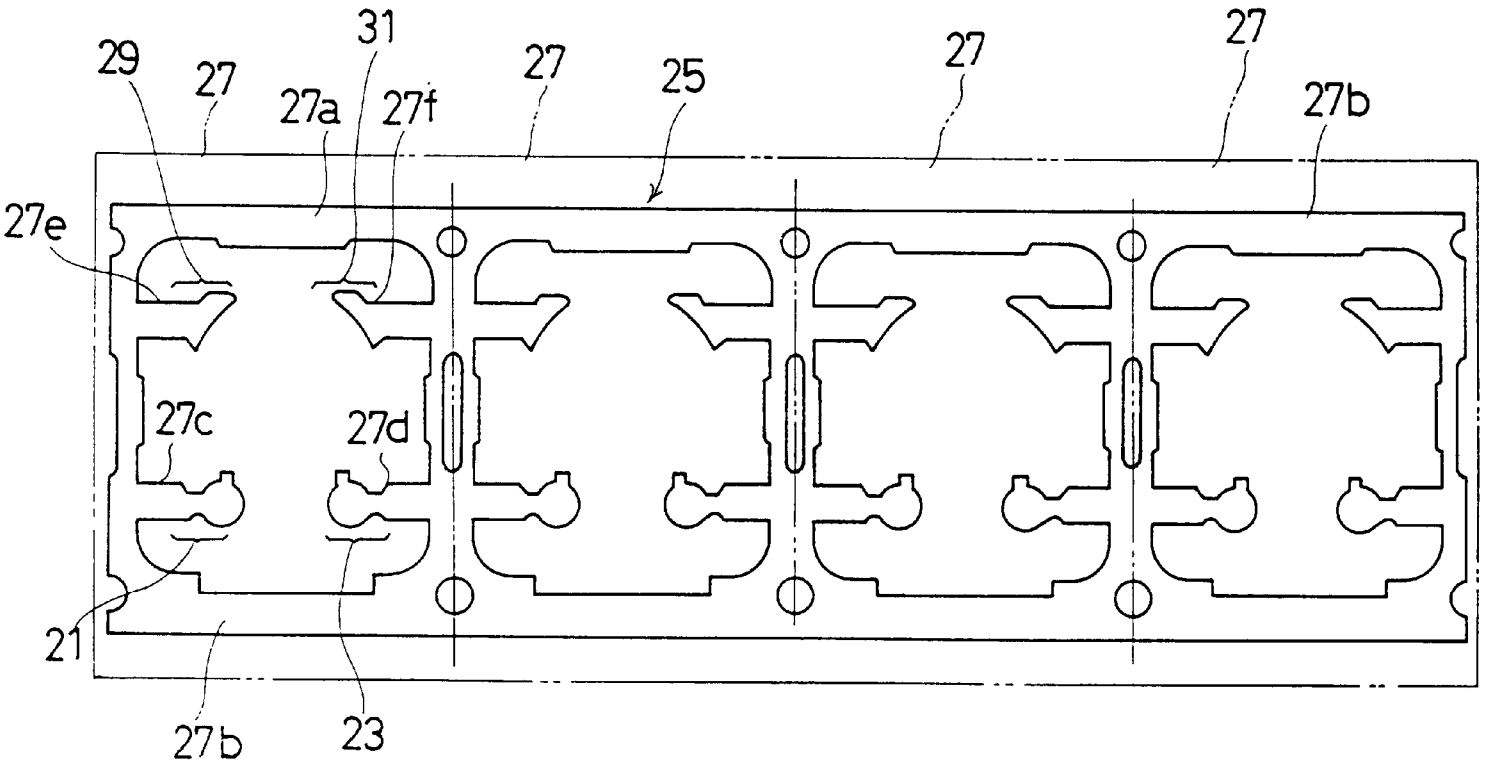
FIG. 5 is a plan view depicting a lead frame according to the first embodiment.
Figure 6:
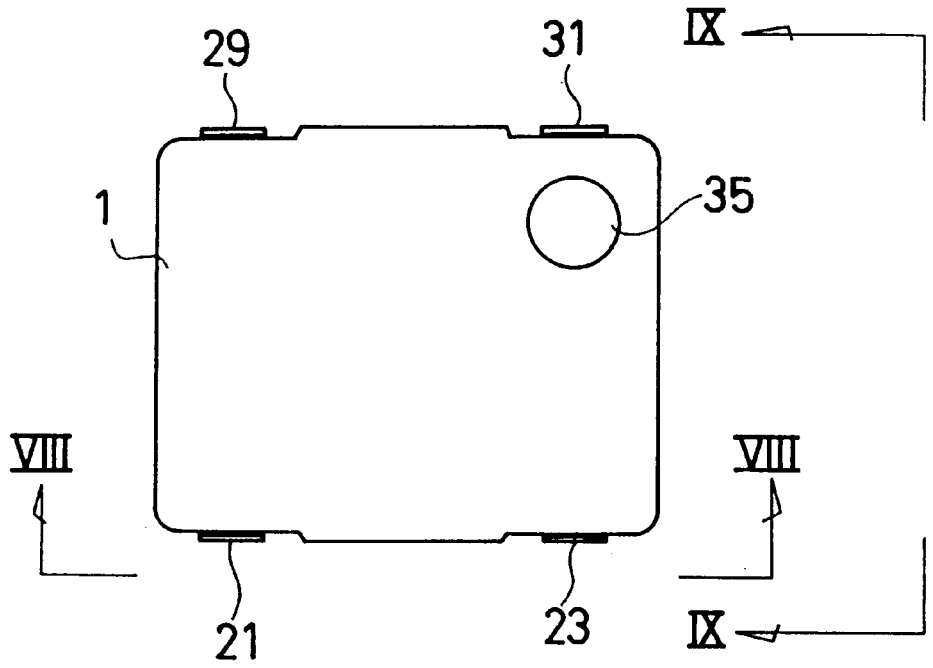
FIG. 6 is a plan view showing the electroacoustic transducer according to the first embodiment as viewed from above.
Figure 7:
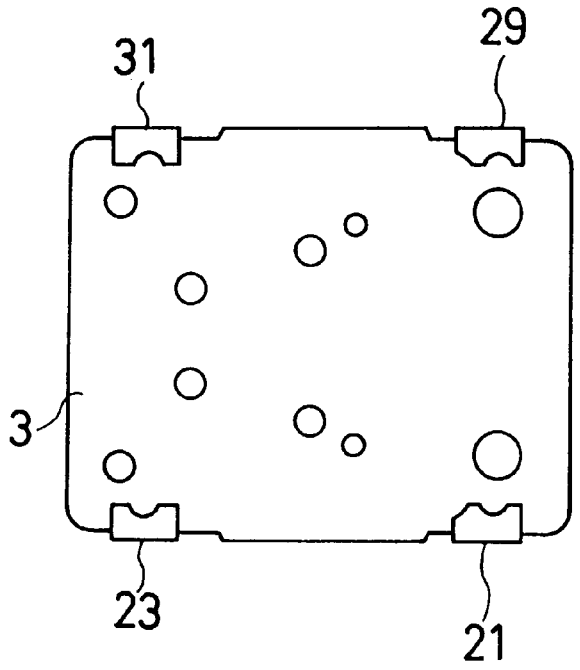
FIG. 7 is a bottom view showing the electroacoustic transducer according to the first embodiment as viewed from bottom.

The aforementioned inserting method will now be discussed specifically. As shown in FIG. 1, a lead frame 25 previously patterned in a predetermined shape is prepared. The lead frame 25 has a plurality of lead frame elements 27 (surrounded by an alternate one long and two short dashes line in FIG. 1) coupled side by side, so that a plurality of electromagnetic type electroacoustic transducers (four electroacoustic transducers in this case) are manufactured at the same time. FIG. 5 shows the details of the lead frame 25. The lead frame element 27 has a pair of wide portions 27*a* and 27*b* extending horizontally in FIG. 5, and protruding pieces 27*c*, 27*d*, 27*e* and 27*f* are provided between the pair of wide portions 27*a* and 27*b*. The distal end portions of the protruding pieces 27*c* and 27*d* become the aforementioned lead terminals 21 and 23.

As shown in FIG. 1, the constituting elements of each electromagnetic type electroacoustic transducer are placed at the proper positions of the lead frame elements 27 of the lead frame 25 in a mold (not shown). Then, a resin is filled in the mold to form the aforementioned base member 3, at which time the lead frame elements 27 partially become integrated with the interior of the base member 3. Thereafter, the lead frame elements 27 are cut along a cut line A shown in FIG. 1 and the exposed portions are bent, providing the state shown in FIG. 3.

Figure 8:
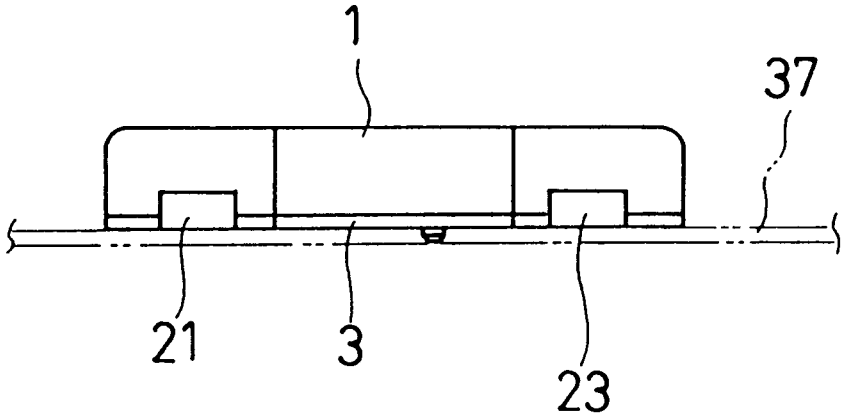
FIG. 8 is a view of the first embodiment as viewed from the direction of VIII—VIII in FIG. 6.
Figure 9:
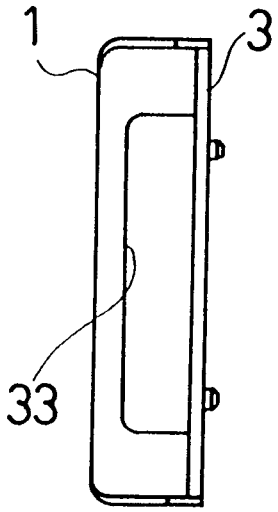
FIG. 9 is a view of the first embodiment as viewed from the direction of IX—IX in FIG. 6.

Besides the lead terminals 21 and 23, terminal members 29 and 31 which do not perform electric functions are likewise integrated with the base member 3. That is, the distal end portions of the protruding pieces 27*e* and 27*f* shown in FIG. 5 become the terminal members 29 and 31. The appearance of the electromagnetic electroacoustic transducer is illustrated in FIGS. 6 through 9. As shown in FIG. 9, formed in one side of the case 1 is a sound port 33 through which sounds are output outside. A polarity mark 35 indicative of a polarity is inscribed on the top of the case 1.

Because the function of the electromagnetic type electroacoustic transducer with the above-described structure is the same as that of the prior art discussed earlier, its description will not be repeated. This electromagnetic type electroacoustic transducer, like the prior art, is to be incorporated into any desired device, such as a portable telephone or a pager. To accomplish this, as shown in FIG. 8, this electroacoustic transducer is attached to a mounting board 37 (indicated by an alternate one long and two short dashes line in FIG. 8) of the device in the illustrated manner, and is soldered thereto via the lead terminals 21 and 23 and the lead terminals 29 and 31 which do not perform electric functions.

The lands 21*a* and 23*a* of the lead terminals 21 and 23 according to this embodiment will now be discussed. shown in FIGS. 1, 3 and 5, the lands 21*a* and 23*a* of the lead terminals 21 and 23 have approximately circular shapes. The lands 21*a* and 23*a* have narrow portions 21*b* and 23*b* at the fore.

Figure 10:
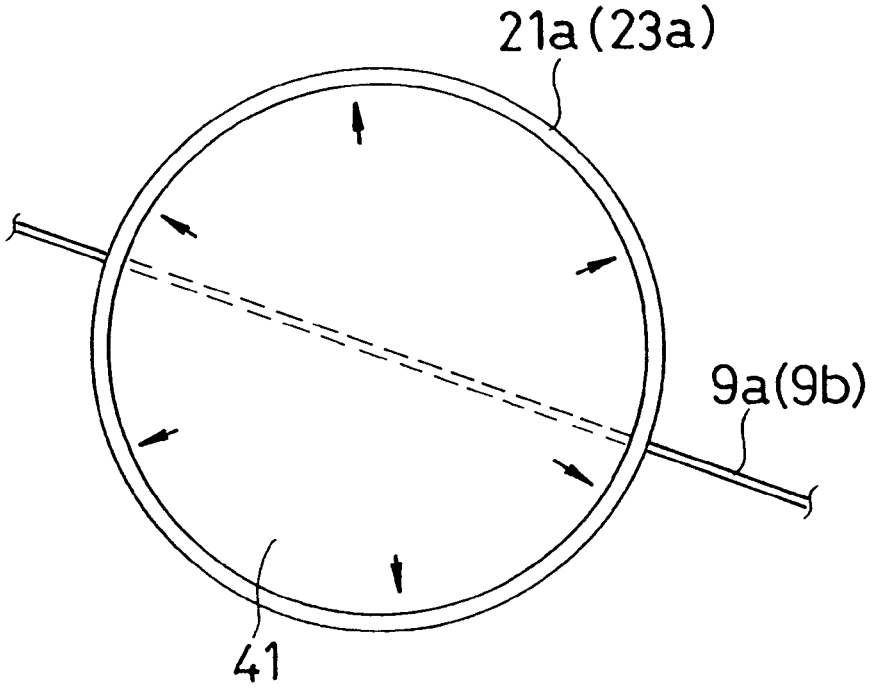
FIG. 10 is a plan view of the first embodiment illustrating a solder paste dropped on a land.
Figure 11:
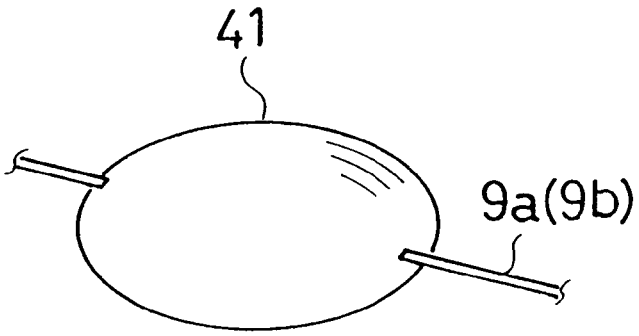
FIG. 11 is a perspective view of the first embodiment illustrating a solder paste dropped on a land.

Designing the shapes of the lands 21*a* and 23*a* as circular can prevent the occurrence of the conventional problem of "solder splitting" at the soldered portion. This will be explained below with reference to FIGS. 10 and 11. When a solder paste 41 is dropped on the lands 21*a* and 23*a*, as has already been discussed in the foregoing section of the prior art, it first becomes as illustrated in FIG. 10 and spreads in a circular shape or a dome shape. If the lands 21*a* and 23*a* have approximately circular shapes, the spreading shape of the solder paste 41 substantially matches with those of the lands 21*a* and 23*a*. It is therefore possible to prevent the occurrence of the undesirable event that the solder paste is strongly pulled in the lengthwise direction of the land, if rectangular as in the prior art, by the surface tension to be split into two at the coil terminal as the boundary.

This embodiment has the following advantage.

As the lands 21*a* and 23*a* have approximately circular shapes which match with the naturally spreading shape of the solder paste 41, the solder paste 41 when dropped is not strongly pulled in a specific direction, thus preventing the conventional problem of "solder splitting." Consequently, the solder 41 is surely and properly applied on the coil terminals 9*a* and 9*b* and its heat certainly melts away the insulator coat and deposited coat portions of the coil terminals 9*a* and 9*b*, exposing the copper wires of the coil 9 to ensure the proper soldering. This prevents improper connection of the coil terminals 9*a* and 9*b* to the respective lands 21*a* and 23*a* and thus prevents the loss of the electric function which would probably be caused by such improper connection.

Further, the solder height at the soldered portion can be set lower. Another conventional attempt to prevent the occurrence of "solder splitting" is to increase the amount of solder to be applied. This scheme inevitably sets the solder height at the soldered portion higher. According to this embodiment, however, "solder splitting" can be prevented due to the above-explained reason without increasing the amount of solder. The reduced solder height at the soldered portion can contribute to designing the electroacoustic transducer compact (thinner) and increasing the volume of the internal resonance space, thus improving the acoustic performance.

FIG. 12 illustrates one example of this embodiment in comparison with the prior art. It is to be noted that soldering was performed with "solder splitting" suppressed in both the embodiment and prior art.

As apparent from FIG. 12, though the areas of the lands 21*a* and 23*a* are slightly larger than those of the conventional lands, the same amount of solder was used in this embodiment and the prior art while the solder height at the soldered portion significantly became lower in this embodiment. Furthermore, the heating time was shorter in this embodiment than in the prior art.

The increased land areas can reduce a variation in the positional deviation of the coil terminals 9*a* and 9*b* and a variation in the height of the finished solder.

Second Embodiment

The second embodiment of the present invention will now be described with reference to FIGS. 13 through 18. Although the lands 21*a* and 23*a* of the lead terminals 21 and 23 are located inside the case 1 in the first embodiment (shown in FIG. 3), this invention can be adapted to the structure in which the lands are located outside the case 1. This structure will now be discussed specifically.

Figure 14:
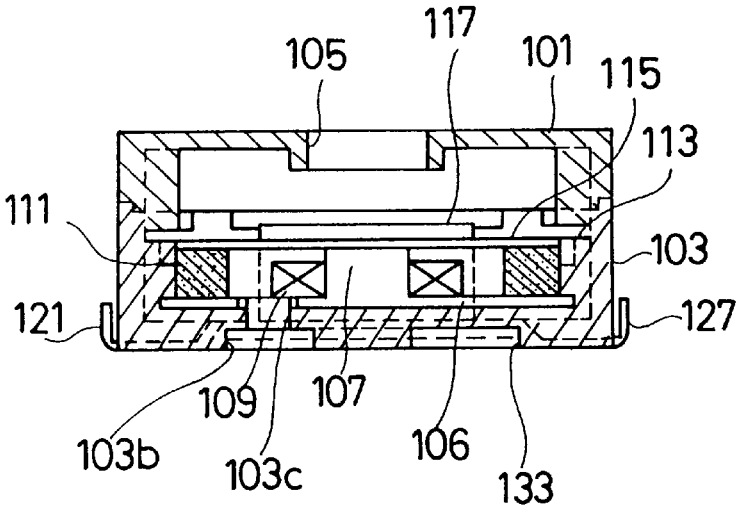
FIG. 14 is a cross-sectional view of the second embodiment taken along the line XIV—XIV in FIG. 13.
Figure 15:
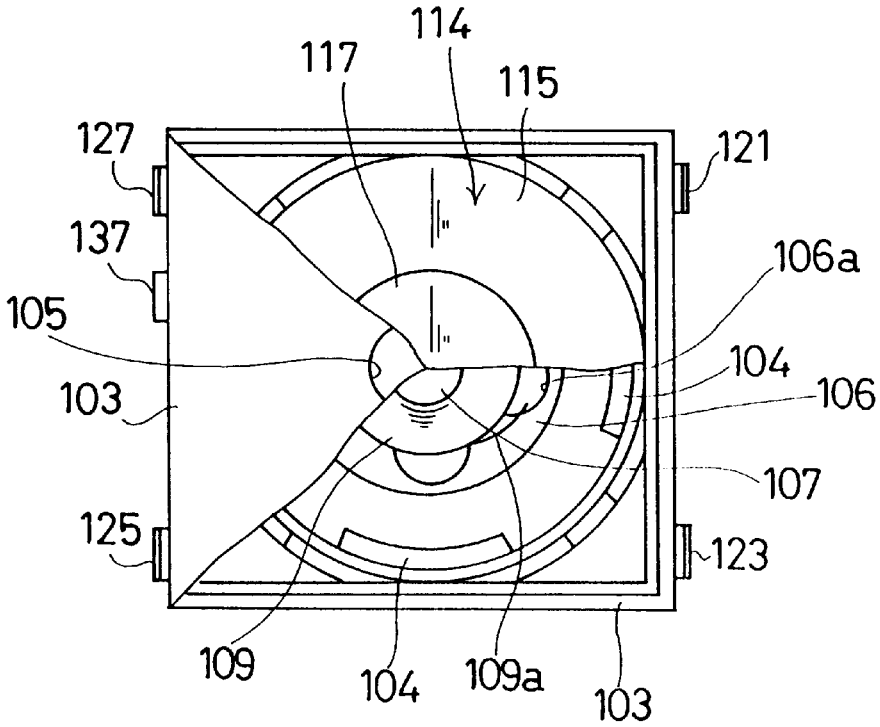
FIG. 15 is a plan view of the second embodiment, showing an elastic plate and a magnetic piece with a part of an upper case cut away, and showing a coil with parts of the elastic plate and magnetic piece cut away.
Figure 16:
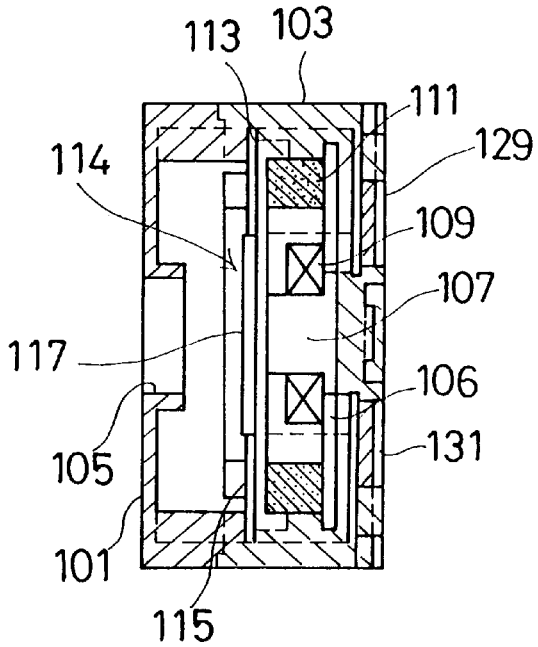
FIG. 16 is a cross-sectional view of the second embodiment taken along the line XVI—XVI in FIG. 13.

As shown in FIGS. 14 and 16, there are an upper case 101 and a lower case 103, with a circular sound port 105 formed in the center of the top face of the upper case 101 in FIG. 14. A base 106 and a core 107 are arranged at the center portion in the lower case 103 in a securely integrated manner, and a coil 109 is wound around the core 107. A magnet 111 is placed around the coil 109 at the inner wall of the lower case 103. As shown in FIG. 15, the magnet 111 is supported at its outer periphery by four support portions 104 (see FIG. 15) protrusively provided on the inner wall of the lower case 103. Formed on the inner wall of the lower case 103 is a step portion 113 at which a diaphragm 114 is provided, as shown in FIGS. 14 and 15. This diaphragm 114 comprises an elastic plate (also called a resonance plate) 115 and a magnetic piece 117 attached as an added mass to the center portion of this elastic plate 115.

FIG. 15 is a plan view showing the elastic plate 115 and the magnetic piece 117 with a part of the upper case 101 cut away, and showing the coil 109 with parts of the elastic plate 115 and magnetic piece 117 cut away.

Figure 13:
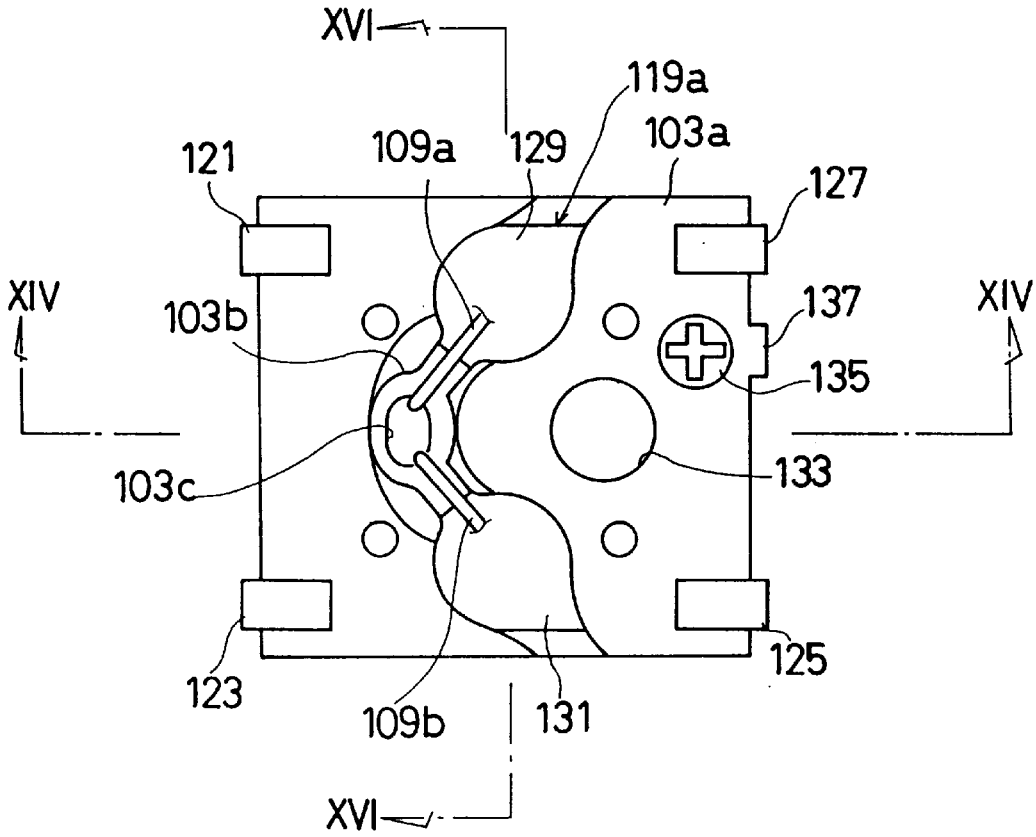
FIG. 13 is a plan view showing an electroacoustic transduce according to the second embodiment of this invention s viewed from the back of a lower case.

The lower case 103 has the bottom structure as shown in FIG. 13 as seen from the bottom side. The lower case 103 has a bottom wall 103*a* in which a groove 103*b* is formed. An opening 103*c* is formed in the center portion of this groove 103*b*.

An opening 106*a* (shown in FIG. 15) is likewise formed in the base 106 located on the inner side of the bottom wall 103*a*, and the opening 103*c* is formed at the position matching with the opening 106*a*.

Figure 17:
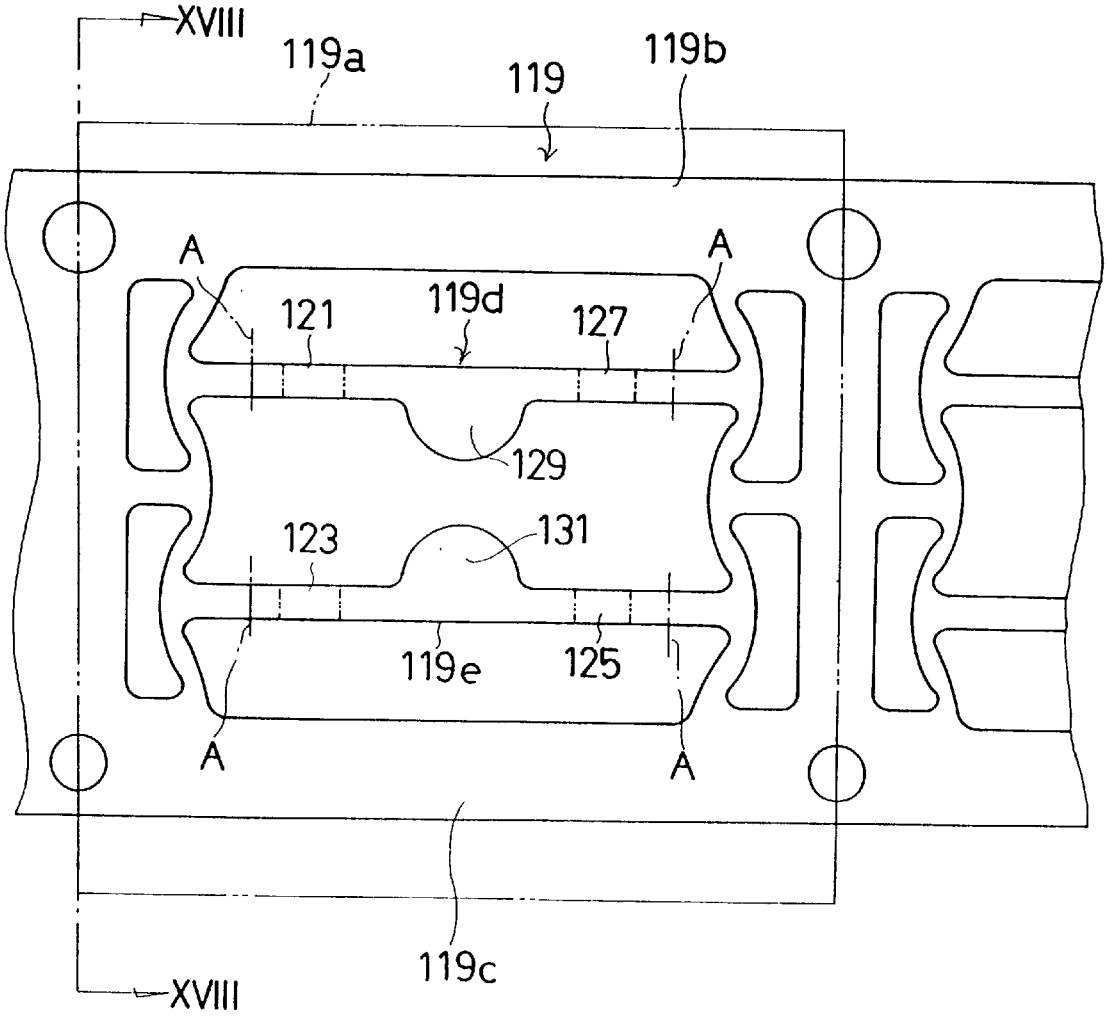
FIG. 17 is a plan view depicting a part of a lead frame according to the second embodiment.

The groove 103*b* obliquely extends nearly symmetrically in the up-and-down direction with the opening 103*c* at the center in FIG. 13. A part of a lead frame element 119*a* of a lead frame 119 shown in FIG. 17 is integrally buried in the bottom wall 103*a* by inserting. The four corner portions of the lead frame element 119*a* are exposed on the lower case 103 as external connection terminals 121, 123, 125 and 127. Some other parts of the lead frame element 119*a* are exposed in the groove 103*b* as lands 129 and 131.

Both coil terminals 109*a* and 109*b* of the coil 109 accommodated in the lower case 103 are led out to the outer side of the bottom wall 103*a* of the lower case 103 through the opening 106*a* of the base 106 and the opening 103*c* of the lower case 103. Those coil terminals 109*a* and 109*b* are placed along the lands 129 and 131 respectively and are securely soldered there.

Figure 18:
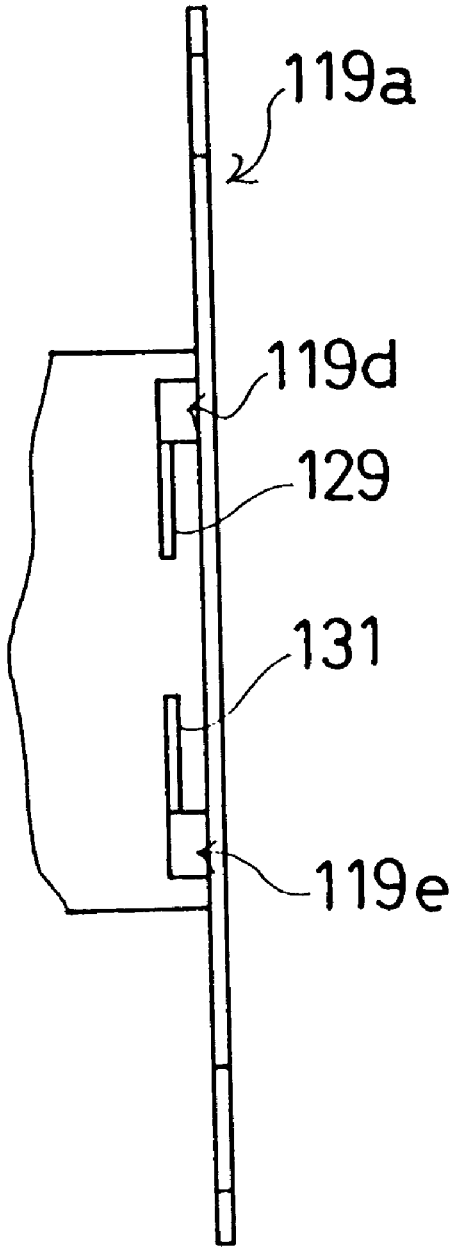
FIG. 18 is a cross-sectional view of the second embodiment taken along the line XVIII—XVIII in FIG. 17.
Figure 19:
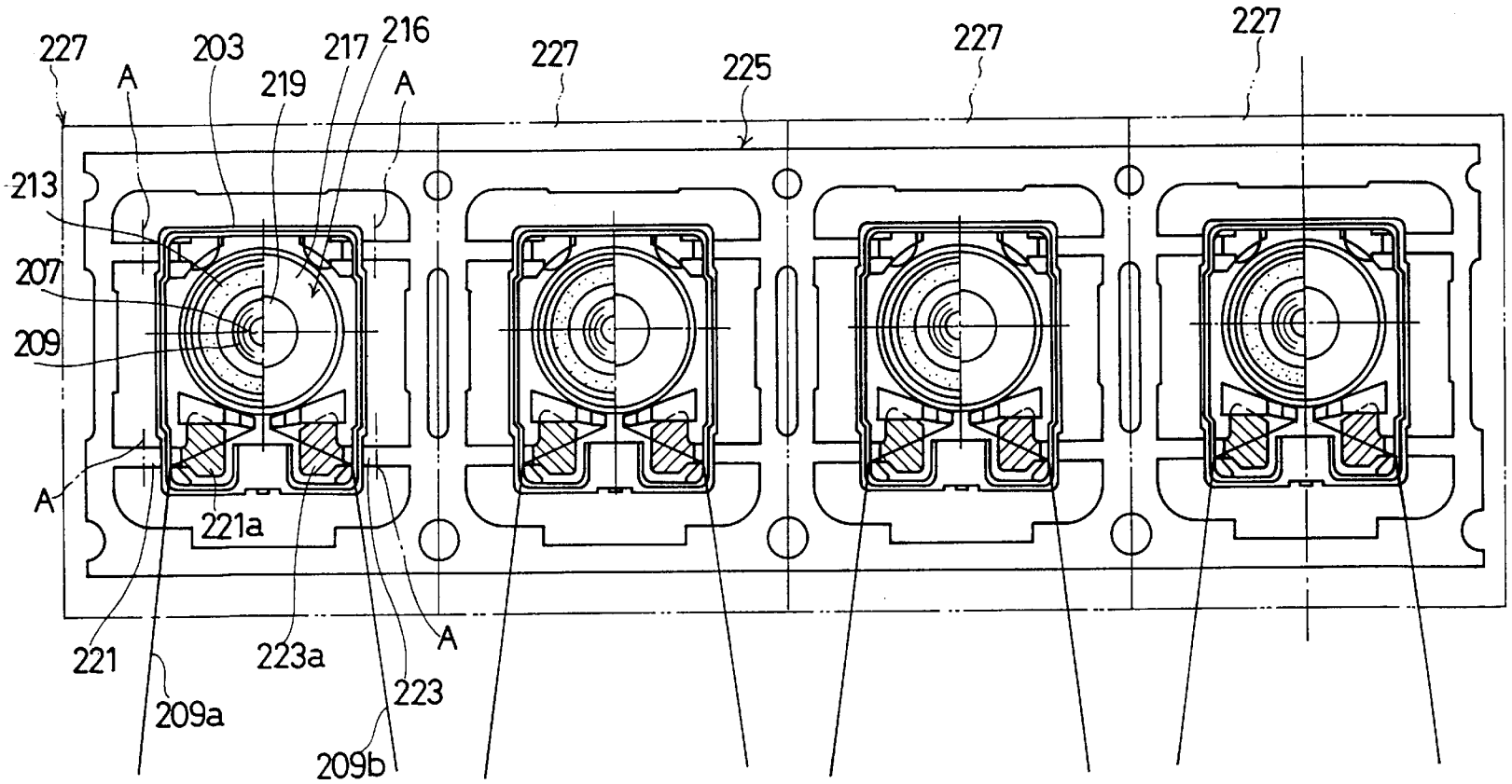
FIG.19 (PRIOR ART)
FIG. 19 is a plan view of an electroacoustic transducer according to the prior art, illustrating how a base member is formed integral, by inserting, with a lead frame on which the components of the electroacoustic transducer are arranged.
Figure 20:
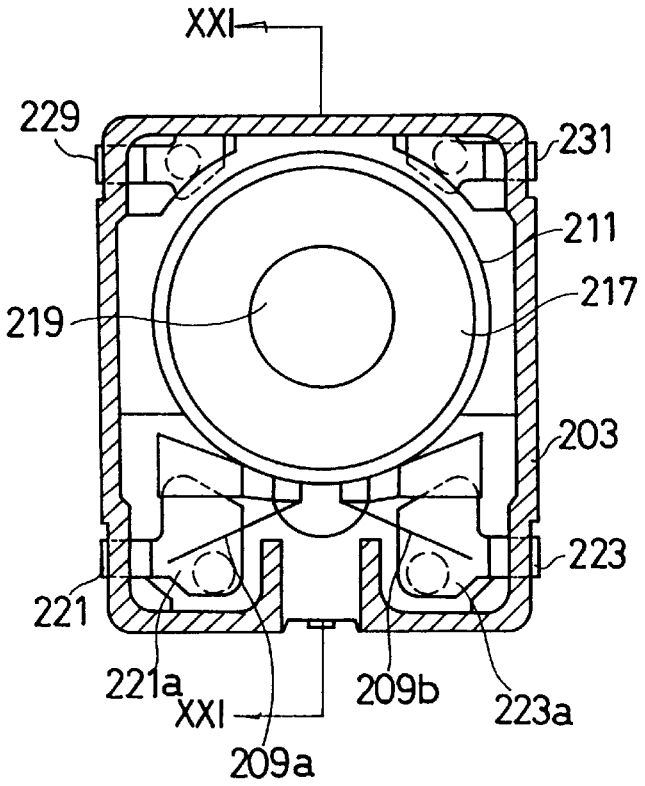
FIG.20 (PRIOR ART)
FIG. 20 is a plan view of the prior art, showing an elastic plate and a magnetic piece with a case cut away.
Figure 21:
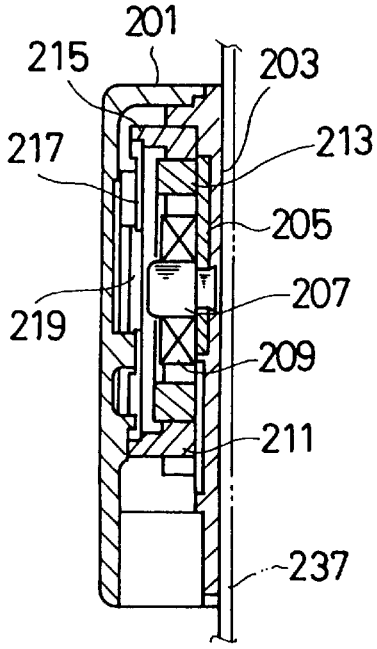
FIG.21 (PRIOR ART)
FIG. 21 is a cross-sectional view of the prior art taken along the line XXI—XXI in FIG. 20.
Figure 22:
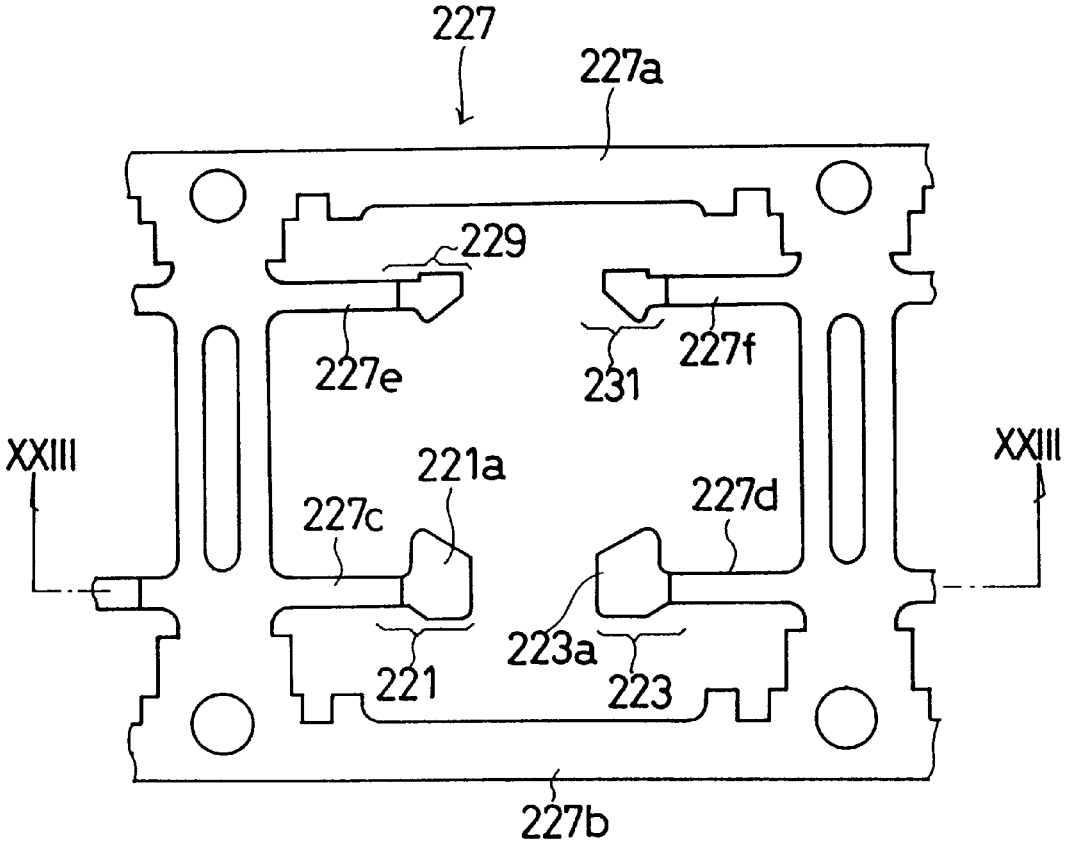
FIG. 22 (PRIOR ART)
FIG. 22 is a plan view depicting a part of a lead frame according to the prior art.
Figure 23:
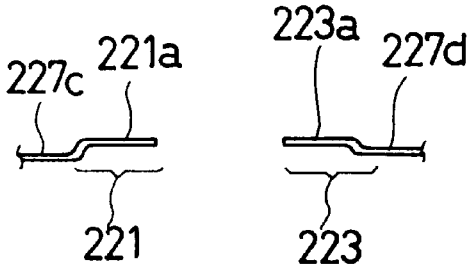
FIG. 23 (PRIOR ART)
FIG. 23 is a cross-sectional view taken along the line XXIII—XXIII in FIG. 22 showing the first embodiment.
Figure 24:
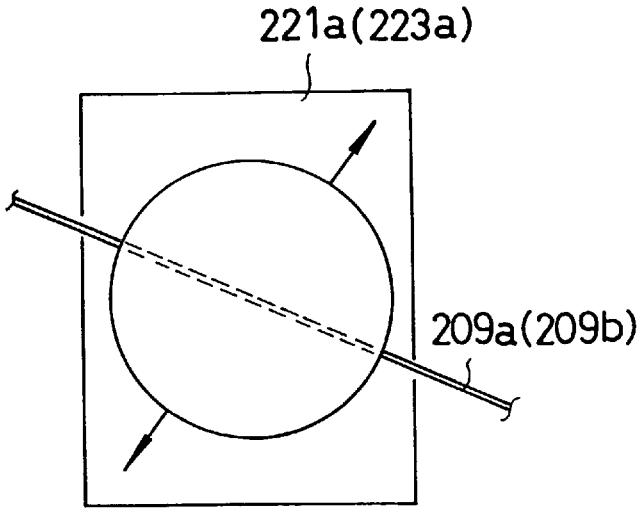
FIG. 24 (PRIOR ART)
FIG. 24 is a plan view of the prior art showing a solder paste dropped on a land.
Figure 25:
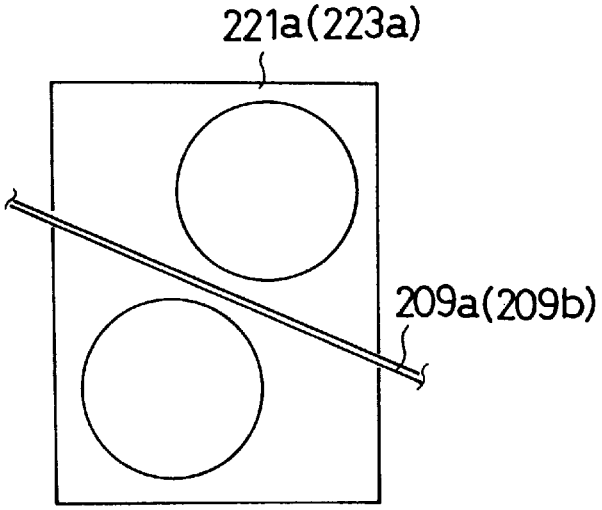
FIG. 25 (PRIOR ART)
FIG. 25 is a plan view of the prior art illustrating how solder splitting has occurred after a solder paste is dropped on a land.
Figure 26:
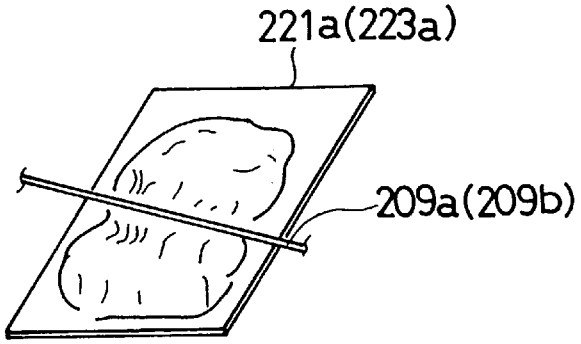
FIG. 26 (PRIOR ART)
FIG. 26 is a plan view of the prior art illustrating how solder splitting has occurred after a solder paste is dropped on a land.

The lead frame 119 will now be discussed specifically. The lead frame 119 has a shape as shown in FIGS. 17 and 18. The lead frame 119 has an arbitrary number of lead frame elements 119*a* (surrounded by an alternate one long and two short dashes line in FIG. 17) coupled side by side, each associated with a single electromagnetic type electroacoustic transducer. The number of lead frame elements 119*a* serially connected is four, six, eight, or the like, for example, and the same number of electromagnetic type electroacoustic transducers are to be manufactured at the same time. The lead frame element 119*a* has wide portions 119*b* and 119*c* located at the top and bottom in FIG. 17 and extending horizontally, and a pair of bridge portions 119*d* and 119*e* provided between the wide portions 119*b* and 119*c*. Portions which become the aforementioned external connection terminals 121, 123, 125 and 127 and portions which become the aforementioned lands 129 and 131 are provided on the bridge portions 119*d* and 119*e*.

With the thus constituted lead frame 119 placed along a mold (not shown), a resin is filled in the mold, yielding the lead frame 119 integrated with the lower case 103. This is the inserting method. Thereafter, the bridge portions 119*d* and 119*e* are cut along a cut line A shown in FIG. 17 and the external connection terminals 121, 123, 125 and 127 are bent toward the upper case 101, providing the state shown in FIG. 13.

In FIGS. 13 and 14, reference numeral "133" indicates the insert hole for letting the resin flow at the time of insertion. In FIG. 13, reference numeral "135" denotes a mark indicating the polarity, and reference numeral "137" is a projection indicating the direction.

The electroacoustic transducer with this structure can have the same advantages as the first embodiment. Further, as the height of the finished solder can be set lower, the outside dimension of the electroacoustic transducer can be reduced.

This invention is not limited to those two embodiments, but may be embodied in many other specific forms without departing from the spirit or scope of the invention. The coil terminals may be connected to the lands by adhesive instead of solder.

What is claimed is:

1. An electroacoustic transducer comprising:

a case portion provided at a lower part of the electroacoustic transducer;

a drive section including a coil disposed on said case portion; and lead terminals integrally formed with said case portion and directly connected to a pair of coil terminals of said coil via a binder, said lead terminals being partially covered by the case portion, thereby having substantially circular lands exposed on the case portion, wherein at least part of said case portion surrounding said lands is made of a material susceptible to heat, and said lands are electrically connected to said pair of coil terminals of said coil, respectively.

2. The electroacoustic transducer as claimed in claim 1, wherein said binder is solder or an adhesive.

3. The electroacoustic transducer as claimed in claim 1, wherein said lands are exposed on the case portion at the side where the drive section is disposed.

4. The electroacoustic transducer as claimed in claim 1, wherein said lands are exposed on the case portion at the side where the drive section is not disposed.

5. The electroacoustic transducer as claimed in claim 1, wherein said lands are substantially solid disks.

* * * * *